US006146038A

United States Patent [19]

Mittersinker et al.

[11] Patent Number: 6,146,038

[45] Date of Patent: Nov. 14, 2000

[54] VARIABLE CONTOUR GRIP

[75] Inventors: Gregor Mittersinker, Warwick; Richard D'Amico, Granston; Mitchell Seamans, Cumberland, all of R.I.; Donald Santos, Rehoboth, Mass.; Ralph Graves, North Kingston, R.I.

[73] Assignee: A.T.X. International, Inc., Lincoln, R.I.

[21] Appl. No.: 09/296,730

[22] Filed: Apr. 22, 1999

[51] Int. Cl.[7] ..... A40B 5/02

[52] U.S. Cl. ..... 401/6; 401/116; 15/443

[58] Field of Search ..... 401/6, 116, 117, 401/48, 52, 195; 18/443; 74/551.9; 473/551, 552; 81/489

[56] References Cited

U.S. PATENT DOCUMENTS

| | | | |
|---|---|---|---|
| 1,868,441 | 7/1932 | Colfelt | 15/443 |
| 2,576,751 | 11/1951 | Dortmund | 81/489 |
| 3,070,370 | 12/1962 | Steiner | 473/295 |
| 4,035,089 | 7/1977 | Schwartz et al. | 401/6 |
| 5,263,275 | 11/1993 | Rumbaugh | 43/23 |
| 5,850,059 | 12/1998 | Yoshimura | 178/19.01 |

*Primary Examiner*—Henry J. Recla
*Assistant Examiner*—Peter deVore
*Attorney, Agent, or Firm*—Notaro & Michalos P.C.

[57] ABSTRACT

A hand instrument with variable grip arrangement has an instrument body of the type to be held between the fingers of the hand for use, the body having an active end and an opposite end. A resilient material forms a grip around the body near the active end. Radial expansion beams are under the grip for bending radially outwardly for expanding the grip into an expanded ergonomic position and for resiliently returning to a straightened condition for contracting the grip into a contracted storage position. Cams or threads or other mechanisms engage the beams for moving them between the expanded and the contracted positions with rotation of a part of the instrument body.

12 Claims, 8 Drawing Sheets

VARIABLE CONTOUR GRIP

FIELD AND BACKGROUND OF THE INVENTION

The present invention relates in general to writing, scribing and lining instruments to be held in the hand such as pens, pencils, markers, styluses, etching tools, scribing tools and the like, and in particular, to a new and useful variable contour grip arrangement for a hand instrument of the type to be held between the fingers of the hand for use.

U.S. Pat. No. 4,035,089 to Schwartz et al. discloses an expandable grip section for a writing instrument which has a lower casing with two struts connected to a tip. A pair of deformable walls supported on a finger grip area around a hollow sleeve encompasses the struts. An expander element is between the sleeve and deformable walls. When the sleeve is rotated, the expander element causes the walls to deform outwardly. The struts themselves are not deformable.

Other patents teach shaped attachments which fit around the body of a writing instrument, such as the anti-nervous grip of U.S. Pat. No. 266,442 to Diedel. The grip is a triangular column which can expand to fit around different sized writing instruments. The flat panels of the triangular column are deformable to provide an improved grip section.

U.S. Pat. No. 1,868,441 to Colfelt discloses an adjustable grip section for a writing instrument. The grip fits over the writing instrument and has a deformable bulbous body enclosing an air space around the writing instrument. The size of the bulbous body may be adjusted by rotating two threaded members.

U.S. Pat. No. 1,598,873 to Peterson discloses a slidable finger grip for a writing instrument which is also used as a cap and a clip. The finger grip is cylindrical with convex sides. The grip is made of resilient material, such as rubber, but does not substantially change shape during use.

U.S. Pat. No. 5,143,463 to Pozil et al. discloses a pear-shaped cylinder writing grip for surrounding a writing instrument body. The grip is made of pliable rubber and shaped to improve the feel of the writing instrument when used over a long period. The writing grip is not integrated with the writing instrument.

Statutory Invention Registration (SIR), H 1050 to Petrillo discloses a resilient grip portion for a writing instrument body adjacent the writing tip. The grip portion is formed by a tubular segment having axial slots. The tubular segment may be integral with the writing instrument body, or a separate piece which is fit over the writing instrument body. The tubular segment is covered by an elongated sleeve.

A writing instrument with a deformable end for enclosing the writing tip is taught by U.S. Pat. No. 5,725,323 to Wittek. The writing tip is propelled outwardly through an expanding end of the barrel adjacent the grip section by depressing the back end of the cartridge the writing tip is part of. When the writing instrument is not used for several minutes, the internal construction of the writing instrument causes the cartridge and writing tip to retract back into the barrel. The grip portion of the writing instrument does not deform.

U.S. Pat. No. 4,595,307 to Heyden discloses a bulbous writing tip cover. The cover is positioned over the writing tip adjacent the grip and is intended solely as a protective cover for the writing tip.

SUMMARY OF THE INVENTION

The present invention comprises a hand instrument which may be a writing instrument, such as a pen, with a retractable writing tip and having a grip section adjacent the writing tip end of the pen. The invention is not limited to writing instruments, however but may be used for any hand instrument of the type which is held between the fingers of the hand of a user during use. Examples include computer styluses, scribing and etching tools, cutting blades and chisels, markers, brushes, surgical instruments and a wide variety of other hand instruments which can benefit by having a grip that can take on an expanded ergonomic position for use, but which also has a contracted position for carrying or storage.

In the case of a pen with retractable tip, when the writing tip is extended or propelled to a writing position, the grip may also deform and expand to the shape or position which is more easily held by a person, namely a preferably triangular ergonomic position. The grip substantially conforms to the outer contour of the writing instrument when the writing tip is retracted.

In one embodiment of the invention, three circumferentially spaced flexible beams inside the grip section are engaged by a cam mechanism and bend outwardly at the same time the writing tip is propelled to a writing position. A deformable grip material, such as silicone rubber, surrounding the beams expands outwardly when the beams bend, providing an expanded grip position for writing.

The beams, which may be made of plastic or metal, resiliently return to their original shape as the writing tip is retracted (repelled). Similarly, the deformable grip material resiliently reverts to the original shape of the pen around the beams.

Other embodiments of the invention use thread mechanisms to selectively and separately activate the writing tip and grip contour.

Accordingly, an object of the present invention is to provide a variable contour grip arrangement for a hand instrument of the type to be held between the fingers of the hand for use, comprising: an instrument body having an active end and an opposite end; a resilient material forming a grip around the body near the active end; radial expansion means in the body and under the grip for expanding radially for expanding the grip into an expanded ergonomic position and for contacting radially for contracting the grip into a contracted storage position; and movable actuation means engaged with the radial expansion means for moving the radial expansion means between the expanded and the contracted positions.

A further object of the present invention is to provide such an arrangement where the instrument is a writing instrument with propelling means for propelling and repelling a writing tip from and into the active end of the body, the movable actuation means either acting with or separately of the propelling means so that the writing tip can either be propelled with expansion of the grip or propelled separately of any movement of the grip.

A further object of the present invention is to provide the expansion means in the form of at least three bendable members in the instrument body which are circumferentially spaced inside the grip and which are bent outwardly by the movable actuation means.

A still further object of the present invention is to provide a variable contour grip arrangement which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
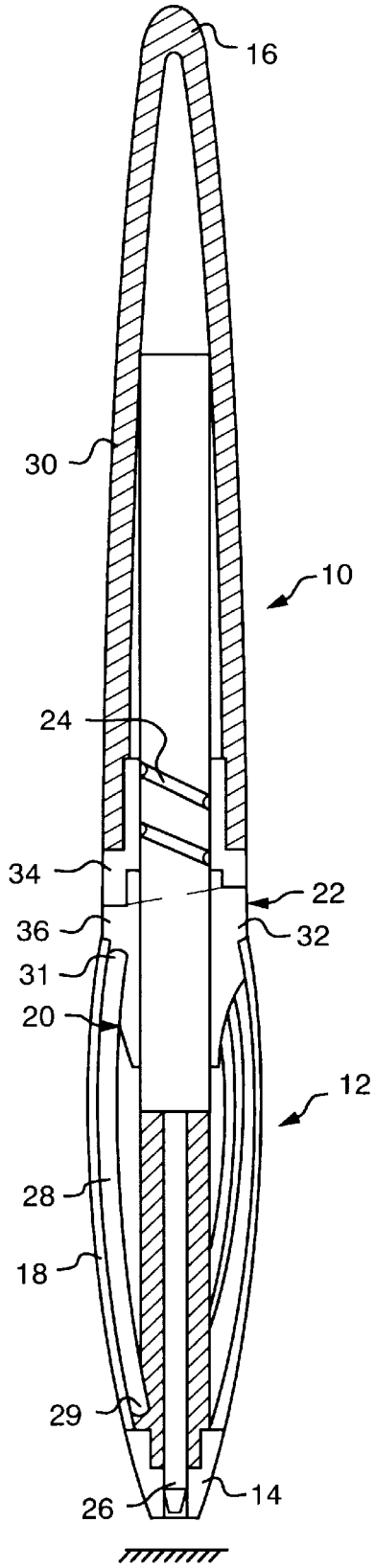
FIG. 1 is an axial sectional view of a hand instrument with variable contour grip arrangement of the present invention.
Figure 5:
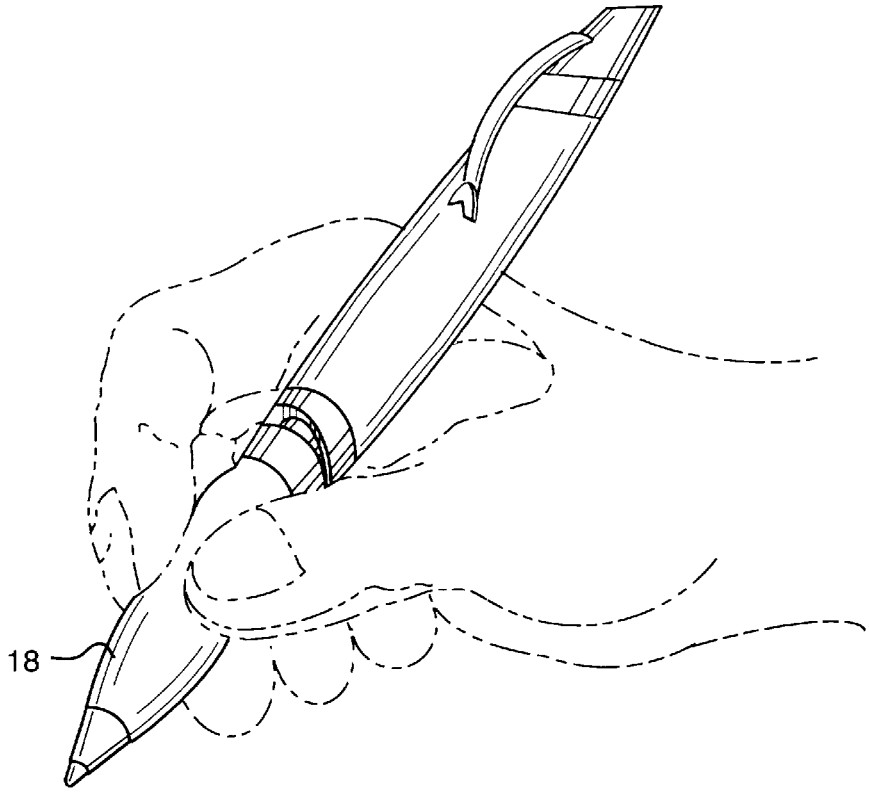
FIG. 5 is a perspective view of the instrument of FIG. 4 as it is being held by the hand of a user for an ergonomic grip.

Referring to the drawings in particular, the invention embodied in FIG. 1 comprises a hand instrument 10 with variable grip arrangement 12. The instrument has an instrument body of the type to be held between the fingers of the hand for use as shown in FIG. 5. The body has an active end 14 and an opposite end 16. A resilient material, such as silicone rubber, forms a grip or sleeve 18 around the body near the active end 14.

Figure 2:
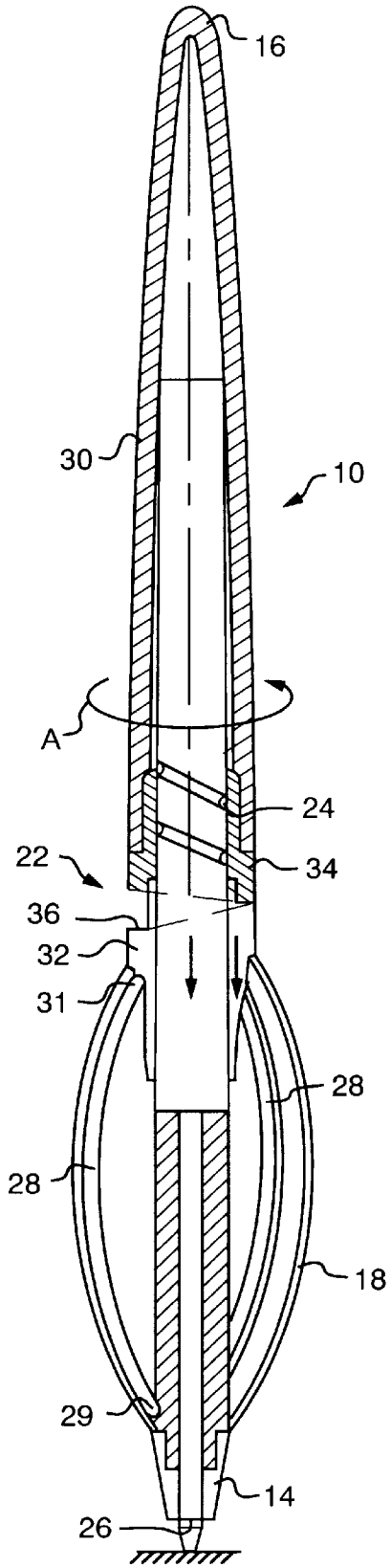
FIG. 2 is a view similar to FIG. 1 of the instrument with its grip in an expanded ergonomic position.
Figure 3:
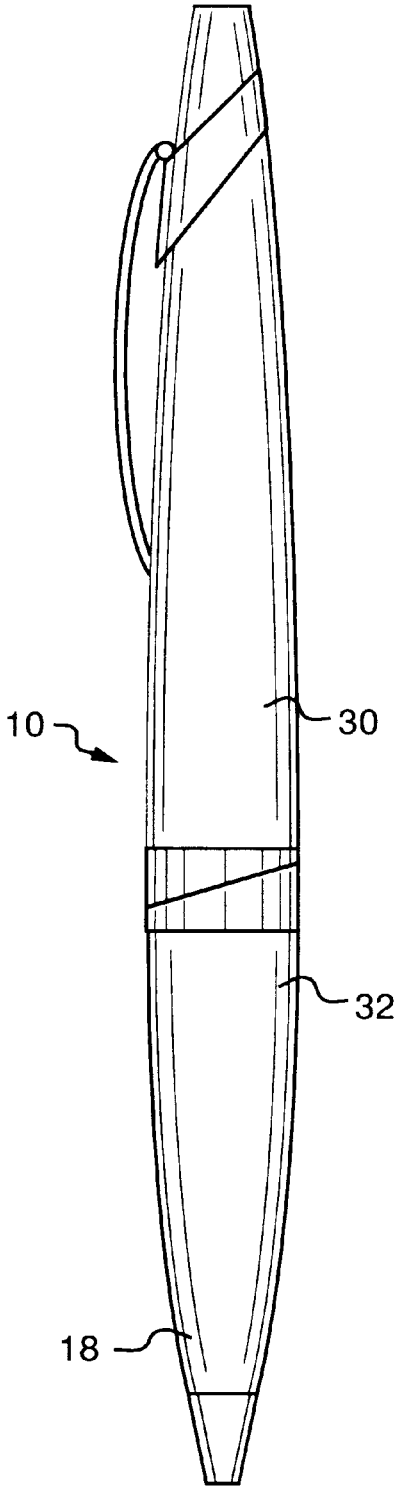
FIG. 3 is a side elevational view of an instrument of the invention with its writing tip repelled (retracted) and its grip contracted into a storage position.
Figure 4:
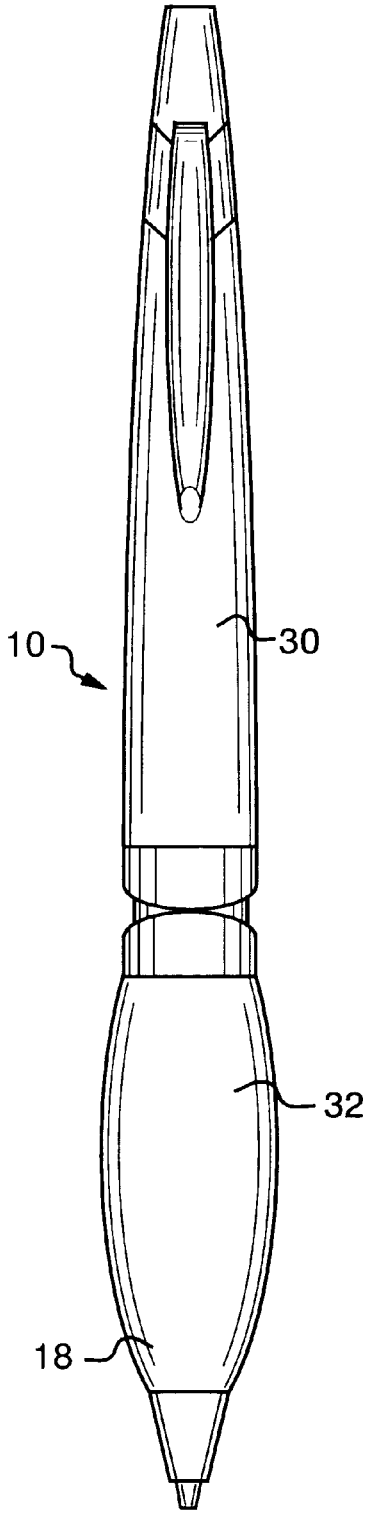
FIG. 4 is a view similar to FIG. 3 with the writing tip propelled (extended) and the grip in its expanded ergonomic position for use.

Radial expansion means 20 in the body 10 and under the grip 18 expand radially for expanding the grip 18 into an expanded ergonomic position shown in FIG. 2, and for contacting radially for contracting the grip into a contracted storage position shown in FIG. 1. Contraction of the grip occurs automatically due to the resilient nature of the grip material which may be SANEPRENE rubber, a trademark for a synthetic rubber.

The radial expansion means are moved by movable actuation means 22 engaged with the radial expansion means for moving the radial expansion means between the expanded and the contracted positions.

In the figures the instrument is a writing instrument with propelling means 24 for propelling and repelling a writing tip 26 from and into the active end 14 of the body 10. The movable actuation means may act with or without the propelling means so that the writing tip is propelled with expansion of the grip or the propelling means and the movable actuation means may acting independently so that the writing tip is propelled independently of expansion of the grip. In the embodiment of FIGS. 1–10, the actions occur together, in the embodiment of FIG. 11, they are independent.

The expansion means 28 in FIG. 1, comprises at least three bendable members 28 in the instrument body which are circumferentially spaced inside the grip 18 and which are bent outwardly by the movable actuation means. Only two of the beams are visible in FIGS. 1 and 2. Three beams are preferred because they create a triangular expanded position, but more beams can be used for a more cylindrical ergonomic grip.

The body 10 includes an upper body portion 30 which carries the opposite end 16, and a lower body portion 32 which carries the grip 18 and the active end 14. The actuation means comprises a fixed cam 34 on body portion 30 and a sliding cam 36 on body portion 32 engaged with the fixed cam 34 for movement with relative rotation of the body portions illustrated by arrow A for bending the bendable members or beams 28.

Figure 9:
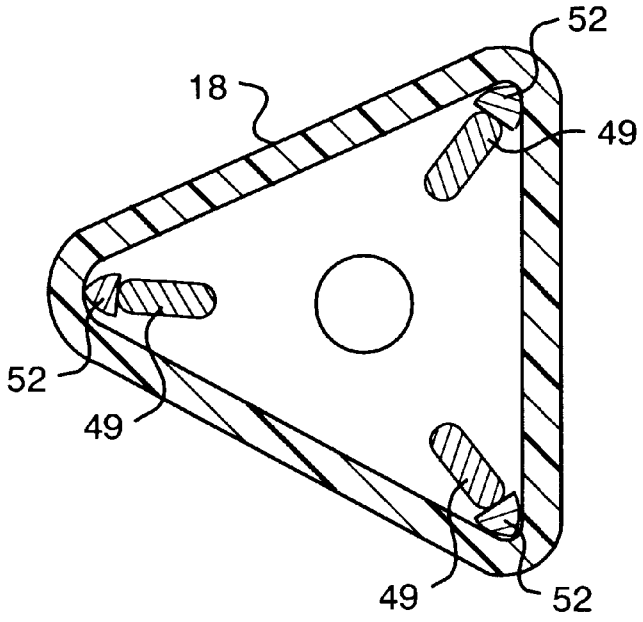
FIG. 9, is a view similar to FIG. 8 but in the expanded position for the grip.
Figure 10:
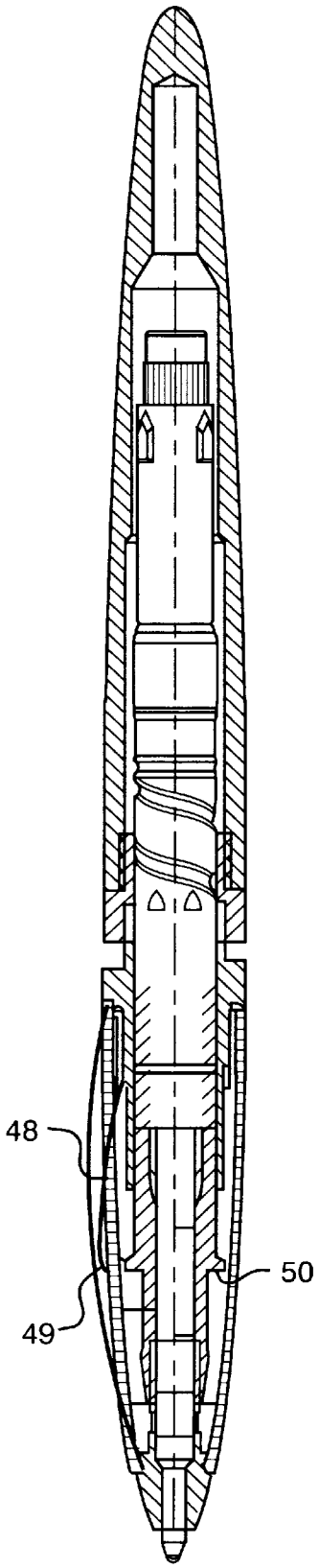
FIG. 10 is a view similar to FIG. 7 showing another embodiment of the invention in a grip expanded position.
Figure 11:
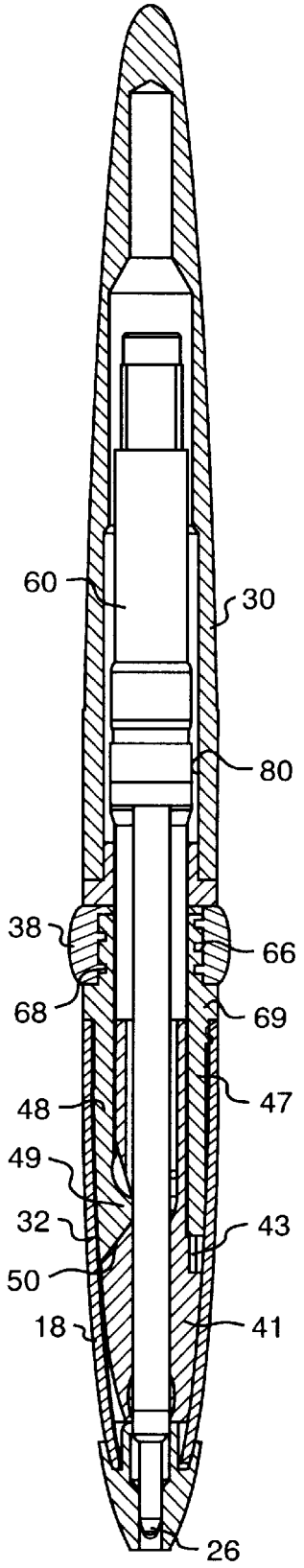
FIG. 11 is a view similar to FIG. 10 showing a still further embodiment of the invention in a grip contracted position.

In the embodiment of FIG. 11, where the same reference numerals are used to designated the same or functionally similar parts, the actuation means comprise thread means between the body portions 30,32 for movement with rotation of a band or ring 38 for bending the bendable members which in the embodiments of FIGS. 7–11, are free ended cantilever beams 48.

Figure 7:
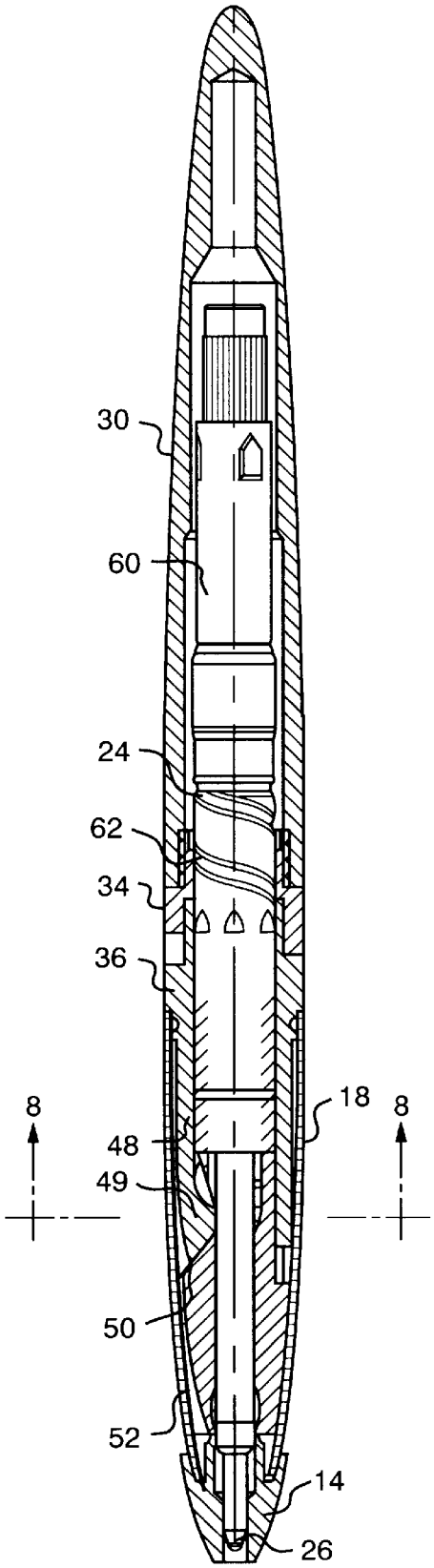
FIG. 7 is an axial sectional view of another embodiment of the hand instrument with variable contour grip arrangement of the present invention.

The free end 49 of the cantilever beams 48 ride on inclined bending surface 50 in the body for bending each beam radially outwardly when each beam moves axially along the inclined surface due to the action of the cam or thread means which moves the upper end of the beams axially downwardly in the figures as is apparent by comparing FIG. 7 (the contracted position) with FIG. 10 (the expanded position).

Figure 6:
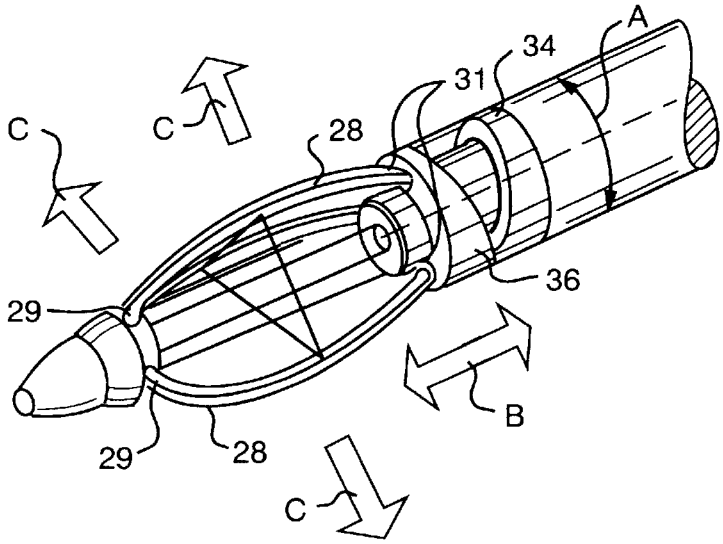
FIG. 6 is an explanatory illustration of one embodiment for the mechanism for varying the contour of the grip of the invention.

In FIGS. 1, 2 and 6 the bendable members 28 each have one fixed end 29 and one axially movable end 31, the axially movable ends being moved axially and together by the actuation means.

FIG. 6 schematically illustrates the action of the cams 34 and 36 which form one embodiment of the actuation means. With relative rotation of one body portion to the other in the direction of arrow A, the movement of the cam surfaces across each other cause axial movement in the direction of arrow B of the upper ends 31 of the bendable members or beams 28, which causes them to belly outwardly in the directions of arrows C.

This expands the resilient outer sleeve or grip 18 (FIG. 2), causing it to take on a rounded triangular cross action shown in FIG. 9.

Figure 8:
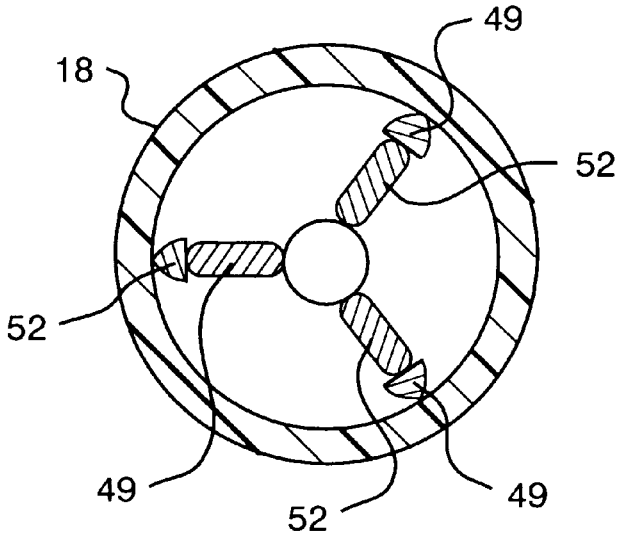
FIG. 8 is a radial sectional view taken along line 8—8 of FIG. 7. showing the grip contour mechanism in its contacted storage position.

As shown in FIGS. 7–9, the free ends 49 of the cantilever beams 48, when sliding cam 36 is moved downwardly by the fixed cam 34 and the relative rotation between the upper and lower body portions, each of the three bendable beams 48 will slide along the radially outwardly extending inclined surface 50, causing the beams to each bend outwardly, as shown for example in FIG. 10.

FIG. 9 shows the outwardly bent positions for the ends 49 of the beams and how this causes the resilient grip 18 to take on a triangular, ergonomic shape shown also in FIG. 5.

Since the outer surfaces of the beams must slide, and further because the inner surface of the grip or sleeve 18 is a high friction surface, it has been found useful to provide plastic slide beams 52 over the bendable beams 48 which also bend outwardly with the beams 48 and which directly contact the inner surface of sleeve 18. Slide beams 52 do not, however, slide with respect to the rubber grip, but beams 48 slide slightly against inner surfaces of beams 52.

FIG. 8 shows the contracted position for the various parts of the invention which produces the smooth outer contour illustrated in FIG. 7 which is more convenient for storage in the pocket or in a storage receptacle, than the expanded ergonomic position, which is useful during use of the pen as shown in FIG. 5.

FIG. 7 also shows details of the propelling mechanism 24 which is of conventional design and includes, for example, a helical groove on the outer surface of a pen refill containing structure 60, in which cam followers 62 on the inside surface of fixed cam 34, ride. When the upper instrument body 30 rotates with respect to the lower, cam followers 62 rotate in the helical groove and cause the writing tip and the entire ink cartridge to move axially downwardly thus projecting the tip 26 beyond the lower active end 14 of the instrument body. A similar mechanism is provided in FIGS. 1, 2 and 10 so that with relative rotation of the body portions, both the writing tip is extended (propelled) and the grip is expanded.

In the embodiment of FIG. 11, ring 38 has inner male threads 66 which engage outer female threads 68 of a threaded projection of a portion 69 which carries the upper ends of the three bendable beams 48 and three non bendable beams 47 which ride in rectangular grooves 43. Beams 48 and beams 47 alternate and are spaced circumferentially around the member 69 so that the axial movement of member 69 is aligned properly and axially with a member 41 which carries the grooves 43 and the inclined surfaces 50 that also alternate and are spaced circumferentially around member 41.

Upper body portion 30 can be rotated with respect to lower body portion 41 and includes on its inner surface at 80, a known mechanism for propelling and repelling the ink cartridge receiving structure 60. Because of the placement of ring 38 at the junction between the upper and lower body portions, one can hold both the ring 38 and the upper body portion 30 and rotate them together to extend the writing tip 26 at the same time that the grip 18 is expanded. Alternatively, the body 30 can be rotated independently for extending the writing tip 26 without expanding the grip 18 and further alternatively, the grip can be expanded without extending the writing tip.

While specific embodiments of the invention have been shown and described in detail to illustrate the application of the principles of the invention, it will be understood that the invention may be embodied otherwise without departing from such principles.

What is claimed is:

1. A writing instrument with variable grip arrangement comprising:

an instrument body of the type to be held between the fingers of the hand for use, the body having an active end and an opposite end;

a resilient material forming a grip around the body near the active end;

radial expansion means in the body and under the grip for expanding radially, for expanding the grip into an expanded ergonomic position and for contracting radially for contracting the grip into a contracted storage position;

propelling means for propelling and repelling a writing tip from and into the active end of the body; and movable actuation means engaged with the radial expansion means for moving the radial expansion means between the expanded and the contracted positions;

the movable actuation means acting with the propelling means so that the writing tip is propelled with expansion of the grip.

2. An arrangement according to claim 1 wherein the expansion means comprises at least three bendable members in the instrument body which are circumferentially spaced inside the grip and which are bent outwardly by the movable actuation means.

3. An arrangement according to claim 2 wherein the body includes an upper body portion which carries the opposite end, and a lower body portion which carries the grip and the active end, the actuation means comprising a fixed cam on one of the body portions and a sliding cam on the other of the body portions engaged with the fixed cam and for movement with relative rotation of the body portions for bending the bendable members.

4. An arrangement according to claim 2 wherein the body includes an upper body portion which carries the opposite end, and a lower body portion which carries the grip and the active end, the actuation means comprising thread means between the body portions for movement with rotation of the actuation means for bending the bendable members.

5. An arrangement according to claim 4 wherein the thread means includes a rotatable ring around the instrument body which is rotatable for bending the bendable members.

6. An arrangement according to claim 2 wherein the bendable members each comprise an bendable cantilever beam and an inclined bending surface in the body engaged with a free end of each beam for bending each beam radially outwardly when each beam moves axially along the inclined surface.

7. An arrangement according to claim 6 including bendable slide beams between each bendable member and the grip.

8. An arrangement according to claim 2 wherein the bendable members each have one fixed end and one axially movable end, the axially movable ends being moved axially and together by the actuation means.

9. A hand instrument with variable grip arrangement comprising:

an instrument body of the type to be held between the fingers of the hand for use, the body having an active end and an opposite end;

a resilient material forming a grip around the body near the active end;

radial expansion means in the body and under the grip for expanding radially for expanding the grip into an expanded ergonomic position and for contracting radially for contracting the grip into a contracted storage position;

movable actuation means engaged with the radial expansion means for moving the radial expansion means between the expanded and the contracted positions;

the expansion means comprising at least three bendable cantilever beams in the instrument body which are circumferentially spaced inside the grip and which are bent outwardly by the movable actuation means, and an inclined bending surface in the body engaged with a free end of each beam for bending each beam radially outwardly when each beam moves axially along the inclined surface; and bendable slide means between the bendable cantilever beams and the grip for allowing relative sliding between the beams and the grip.

10. An arrangement according to claim 9 wherein the instrument is a writing instrument with propelling means for propelling and repelling a writing tip from and into the active end of the body, the movable actuation means acting with the propelling means so that the writing tip is propelled with expansion of the grip.

11. An arrangement according to claim 9 wherein the instrument is a writing instrument with propelling means for propelling and repelling a writing tip from and into the active end of the body, the movable actuation means acting independently of the propelling means so that the writing tip is propelled independently of expansion of the grip.

12. An arrangement according to claim 9, wherein the bendable slide means comprise bendable slide beams.

* * * * *